United States Patent [19]

Janko

[11] 4,137,479

[45] Jan. 30, 1979

[54] CATHODE RAY TUBE HAVING AN ELECTRON LENS SYSTEM INCLUDING A MESHLESS SCAN EXPANSION POST DEFLECTION ACCELERATION LENS

[75] Inventor: Bozidar Janko, Portland, Oreg.

[73] Assignee: Tektronix, Inc., Beaverton, Oreg.

[21] Appl. No.: 757,425

[22] Filed: Jan. 6, 1977

[51] Int. Cl.[2] ..... H01J 29/70; H01J 29/62

[52] U.S. Cl. ..... 313/426; 313/432; 313/434

[58] Field of Search ..... 313/397, 437, 458, 460, 313/421, 426, 449, 432

[56] References Cited

U.S. PATENT DOCUMENTS

| | | | |
|---|---|---|---|
| 2,412,687 | 12/1946 | Klemperer | 313/460 |
| 2,520,813 | 8/1950 | Rudenberg | 313/460 X |
| 3,496,406 | 2/1970 | Deschamps | 313/429 X |
| 3,497,744 | 2/1970 | Himmelbauer et al. | 313/432 |
| 3,792,303 | 2/1974 | Albertin et al. | 313/429 X |
| 3,922,580 | 11/1975 | Hutter | 313/432 X |

*Primary Examiner*—Robert Segal
*Attorney, Agent, or Firm*—Adrian J. La Rue

[57] ABSTRACT

A cathode ray tube includes first and second electrostatic quadrupole lens between the electron gun and the vertical deflection plates to properly focus the electron beam before it enters the vertical deflection plates. A third electrostatic quadrupole lens is located between the vertical deflection plates and the horizontal deflection plates to enhance the angle of deflection as well as to properly focus the electron beam as it moves from the vertical deflection plates into the horizontal deflection plates. A meshless scan expansion lens follows the horizontal deflection plates and is formed of aligned tubular members having interdigitated sections thereby forming a fourth quadrupole lens which accelerates the electron beam and expands it prior to being impinged onto the fluorescent screen.

4 Claims, 4 Drawing Figures

CATHODE RAY TUBE HAVING AN ELECTRON LENS SYSTEM INCLUDING A MESHLESS SCAN EXPANSION POST DEFLECTION ACCELERATION LENS

BACKGROUND OF THE INVENTION

It is known as disclosed in U.S. Pat. No. Re. 28,223 to Odenthal et al. to use a dome-shaped mesh electrode in a cathode ray tube to expand the scan of an electron beam thereof. It is not desirable to use a dome-shaped mesh electrode because it becomes contaminated and because the mesh intercepts the beam thereby minimizing the number of electrons that reach the fluorescent screen, and the mesh creates a multiplicity of lenses which introduce aberrations into a well-focussed electron beam.

U.S. Pat. No. 3,496,406 to J. Deschamps is directed to a cathode ray tube having an electrostatic quadrupole lens downstream from horizontal deflection plates which is disposed within a dome-shaped electrode having a slot therethrough. The combination of the quadrupole lens and dome-shaped electrode constitutes a lens system which causes the paths of electrons to cross over in the vertical plane and to be accelerated through the slot in the dome-shaped electrode so that the focussed electron beam impinges on the fluorescent screen.

U.S. Pat. No. 3,792,303 to Albertin et al. is an improvement of the Deschamps cathode ray tube in that the Albertin et al invention uses correcting electrodes disposed at either side of the quadrupole lens in order to correct for pin cushion distortion, i.e., the bowing of the horizontal and vertical lines. These quadrupole lens and dome-shaped electrode structures are difficult to manufacture and to position relative to each other when being mounted within a cathode ray tube thereby introducing aberrations into the electron beam which results in less brightness of the image being displayed on the fluorescent screen.

Klemperer in U.S. Pat. No. 2,412,687 teaches the basic concept of an electron lens for use in a cathode ray tube having aligned tubular members which are provided with interdigitated sections defining nonrotationally-symmetrical lens with two-fold symmetry, but the tubular members do not have interdigitated sections which are provided with parts having different radii to provide distortion-free imaging.

SUMMARY OF THE INVENTION

The present invention relates to improvements in cathode ray tubes and more particularly to cathode ray tubes employing electrostatic deflection and having means for deflection amplification and post-deflection acceleration.

In accordance with the present invention, a cathode ray tube is provided with adjacent quadrupole lens for focussing the electron beam prior to the beam passing into the vertical deflection plates. The electron beam after being vertically deflected in the vertical deflection plates passes into another quadrupole lens which focusses the vertically-deflected beam and enhances the angle of deflection as the electron beam then passes between the horizontal deflection plates which horizontally deflects the electron beam. The scan and geometry of the horizontally-deflected electron beam is made more linear as it passes through a linear geometry correction electrode. The electron beam then moves into a post deflection acceleration expansion lens comprising aligned tubular members having interdigitated sections defining a further quadrupole lens which expands the scan of the electron beam and accelerates it for impingement on the fluorescent screen in a substantially distortionless manner.

An object of the present invention is to provide a cathode ray tube having a meshless scan expansion post deflection acceleration lens system to produce a brighter image without adding aberrations thereto.

Another object of the present invention is the provision of a cathode ray tube having aligned tubular members provided with interdigitated sections defining a quadrupole lens for expanding the scan of an electron beam and simultaneously accelerating it for impingement onto a fluorescent screen.

A further object of the present invention is to provide a quadrupole lens for use in a cathode ray tube for expanding the scan of an electron beam and simultaneously accelerating the beam for impinging it onto a fluorescent screen and which includes aligned tubular members having interdigitated sections with the interdigitated section of one of the aligned tubular members having different portions with outer portions having the same radius and a mediate portion having a radius different from the radius of the outer portions.

An additional object of the present invention is the provision of a cathode ray tube having quadrupole lens means positioned before the vertical deflection plates, quadrupole lens means positioned between the vertical deflection plates and the horizontal deflection plates and accelerating quadrupole lens means after the horizontal deflection plates.

Still another object of the present invention is to provide a meshless scan expansion post deflection acceleration lens system for use in a cathode ray tube that provides better linearity and geometry of the electron beam scan so as to eliminate distortions such as pin cushion and barrel effects to the electron beam.

The novel features which are believed to be characteristic of the invention together with further objects and advantages thereof will be better understood from the following description considered in connection with the accompanying drawings in which a preferred embodiment of the invention is illustrated by way of example. It is to be understood, however, that the drawings are for the purpose of illustration and description only and are not intended as a definition of the limits of the invention.

DETAILED DESCRIPTION OF THE INVENTION

Figure 1:
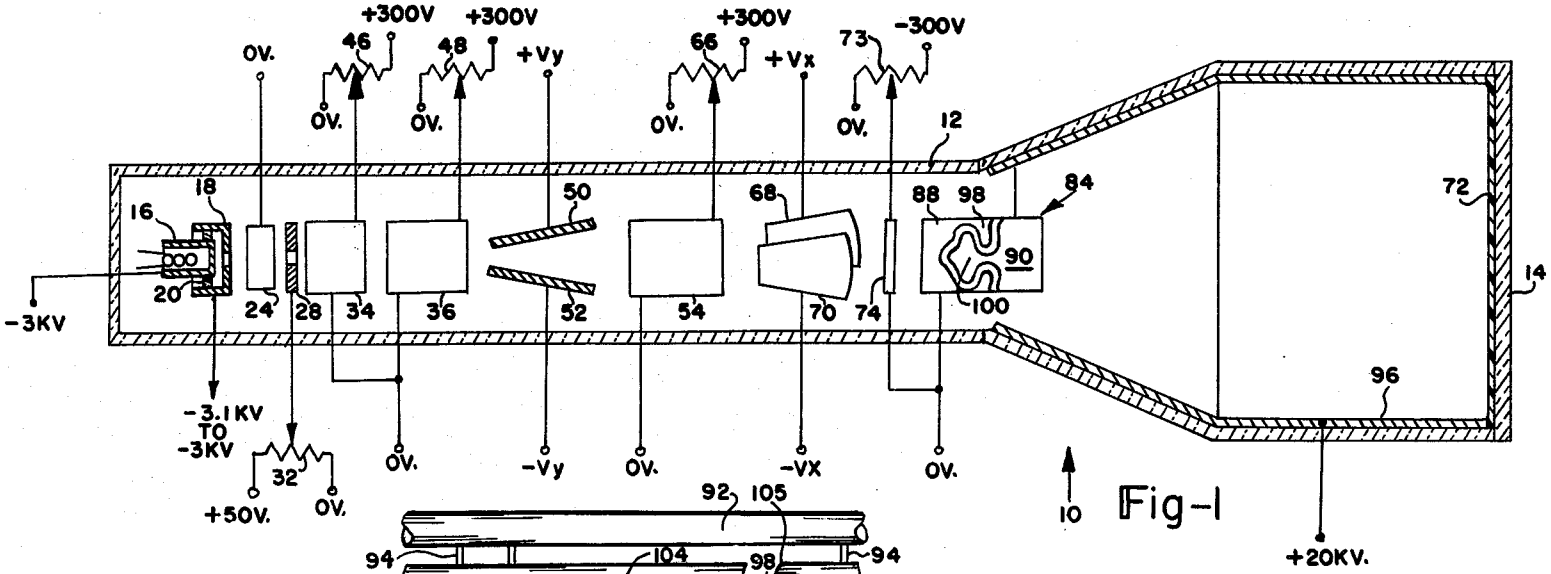
FIG. 1 is a schematic longitudinal sectional view of the improved cathode ray tube in accordance with the invention which is taken along the central vertical plane of the tube.
Figure 4:
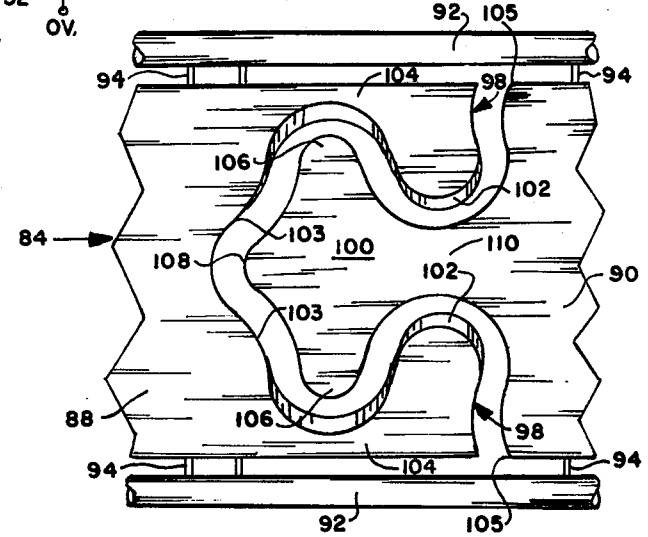
FIG. 4 is a side elevational view showing parts of the tubular members including the interdigitated sections of the meshless scan expansion lens.

In reference to the drawings, a cathode ray tube 10 is provided with an envelope 12 the neck section of which is preferrably formed of glass in which the electron optics system is disposed and the funnel section of which is preferrably formed of ceramic having a glass faceplate 14 frit sealed thereonto. The glass section and ceramic section are also frit sealed together. Such an envelope is disclosed in U.S. Pat. No. 3,207,936.

The electron optics system includes a heated cathode 16 that is connected to −3KV. for generating an electron beam. A grid electrode 18 is disposed adjacent to and has cathode 16 mounted therein via a ceramic member 20. Grid 18 is connected to −3.1 to −3KV. and it is connected to a cross-shaped plate 22 that is mounted to glass rods 23 and has an aperture 22a therethrough to enable the electron beam to pass thereoutof. Grid electrode 18 controls emission of the electron beam as it passes through the aperture. An anode 24 is located adjacent grid electrode 18 which is connected to 0V., and it is mounted to glass rods 23 via cross-shaped plates 26 which have apertures 26a to permit the electron beam to enter and leave the anode. Anode 24 accelerates the electron beam as it passes therethrough.

Stigmator lens 28 is a plate that is secured to glass rods 23 and it has an oblong aperture 30 (FIG. 2) therethrough which is tilted at about 45° relative to a vertical plane that passes through the tube axis. Stigmator lens 28 is connected to a movable contact of a potentiometer 32 which has on end connected to 0V. and the other end connected to +50V. Stigmator lens 28 corrects for beam astigmatism.

Focus lens are disposed adjacent stigmator lens 28 and include a first quadrupole lens 34 and a second quadrupole lens 36. Each of these quadruple lens is formed from a series of substantially circular plates 38 which are disposed between cross-shaped plates 40 and these plates are secured in glass rods 23. Cross-shaped plates 40 have circular apertures 42 therethrough, whereas plates 38 have apertures 44 therethrough. Apertures 44 are of the same size and they have opposing inwardly-curved and opposing outwardly curved surfaces. Alternate plates 38 are electrically connected together and apertures 44 therein are disposed in the same direction while the other alternate plates 38 are electrically connected together and apertures 44 therein are disposed in the same direction but at right angles to apertures 44 in the first alternate plates 38. One side of each of quadrupole lens 34 and 36 is connected to 0V. and the other side thereof is connected to a movable contact of potentiometers 46 and 48, the ends of potentiometers 46 and 48 being connected respectively to 0V. and +300V. Quadrupole lens 34 converges the electron beam in the X-Z plane and diverges it in the Y-Z plane whereas quadrupole lens 36 diverges the electron beam in the X-Z plane and converges it in the Y-Z plane.

Vertical deflection plates 50 and 52 are positioned on opposite sides of the tube axis and they are secured to glass rods 23 to maintain them in position. Vertical deflection plate 50 is connected to +V. and vertical deflection plate 52 is connected to −V. so that an input signal connected thereto will be applied to these plates and deflect the electron beam in accordance thereto as the electron beam passes therealong. A vertical deflection structure as taught in U.S. Pat. No. Re. 28,223 can also be used in place of plates 50 and 52 if desired.

Third quadrupole lens 54 is formed from cross-shaped plates 56 with substantially circular plates 58 therebetween. Plates 56 have oblong openings 60 therethrough which extend in the same direction as a vertical plane containing the tube axis. The first and third plates 58 are electrically connected together and they have openings 62 therethrough which have opposing inwardly-curved surfaces and outwardly-curved surfaces. The second and fourth plates 58 are connected together and they have openings 64 therethrough which also have inwardly-curved opposing surfaces and outwardly-curved opposing surfaces. Openings 62 are disposed at right angles with respect to openings 64, and openings 62 can be larger in size than openings 64. One side of lens 54 is connected to 0V. and the other side is connected to the movable contact of a potentiometer 66 with the ends thereof being connected to 0V. and +300V. This third quadrupole lens 54 constitutes a scan expansion lens which converges the electron beam in the X-Z plane and diverges it in the Y-Z plane. This lens 54 also enhances the angle of deflection of the electron beam which has been applied thereto via vertical deflection plates 50 and 52.

As pointed out above, the quadrupole lens 34, 36 and 54 are preferably formed from cross-shaped and circular plate members having specific openings therethrough; however, these quadrupole lens can be made in accordance with the quadrupole lens disclosed in U.S. Pat. Nos. 3,496,406 and 3,792,303.

Horizontal deflection plates 68 and 70 are positioned on each side of the tube axis and they are maintained in position by being mounted to glass rods 23. These horizontal deflection plates are connected to conventional sweep circuitry to sweep the electron beam across the phosphor screen 72 which is disposed on the inside surface of faceplate 14.

A linear and geometry correction lens 74 is positioned adjacent the horizontal deflection plates and includes a cross-shaped plate 76 having an oblong opening 78 therethrough extending in the same direction as oblong openings 60 and substantially circular plates 80 having openings 82 extending therethrough which have inwardly-curved opposing surfaces and outwardly-curved opposing surfaces. The openings 82 in plates 80 are shifted 45° with respect to each other. One side of lens 74 is connected to 0V. and the other side is connected to a movable contact of a potentiometer 73 that has its ends connected to 0V. and −300V. Lens 74 acts on the electron beam to shape the field thereby making the scan more linear.

A post deflection acceleration scan expansion lens 84 is positioned adjacent lens 74 and mounted via an annular ring 86 to glass rods 23. Lens 84 acts upon the electron beam as an accelerating quadrupole lens. Lens 84 includes aligned tubular members 88 and 90 which are maintained in positon relative to the tube axis and relative to one another via glass rods 92 secured onto pins 94. Tubular members 88 and 90 are preferably round and tubular member 88 is connected to 0V. whereas tubular member 90 is connected to a conductive coating 96 which is disposed on the inner surface of the funnel section of envelope 12. Conductive coating 96 is connected to +20KV. so that tubular member 90 and phosphor screen 72 are connected to +20KV.

Tubular members 88 and 90 have interdigitated bilobular and trilobular sections 98 and 100 respectively. Bilobular sections 98 are opposing each other and each section 98 has lobes 102 that extend outwardly from a necked-down section 104. The lobes 102 extend outwardly from section 104 in a slightly upwardly-directed manner and they have radiussed ends of the same radius. The outer surface connecting the lobes 102 and necked-down section 104 is curved inwardly. Necked-down section 104 and lobes 102 have an arcuate configuration in cross section equidistant from the tube axis.

Trilobular sections 100 oppose each other and each is provided with outer lobes 106 and a middle lobe 108 which extend outwardly from necked-down section 110 which is larger than necked-down section 104. Sections 110 have substantially the same configuration as that of bilobular sections 98 except that sections 110 are provided with middle lobes 108 having a radius different from outer lobes 106. As can be discerned, tubular members 88 and 90 have cutouts conforming to the configurations of bilobular sections 98 and trilobular sections 100 so that they interdigitally fit therein to provide the unique lens 84 which operates as an accelerating quadrupole lens which diverges the electron beam in the X-Z plane and converges it in the Y-Z plane. The electron beam axis in the Y-Z plane is converged so strongly that it crosses the tube axis and it appears on the screen on the opposite side of the tube axis.

Tubular member 84 also includes lobes 103 opposite each of the arcuate surfaces that connect lobes 106 and 108 together. Tubular member 90 also includes lobes 105 which are disposed opposite the inwardly-curved surfaces that connect lobes 102 together. Thus, each tubular member 88 and 90 contains eight lobes.

The post deflection acceleration scan expansion lens 84 in conjunction with accelerating electrode 96 provides better linearity and geometry to the electron beam scan and eliminates distortions thereto such as pin cushion and barrel effects. The brightness of the information displayed by the electron beam impinging a phosphor screen 72 is higher.

Figures 2, 3:
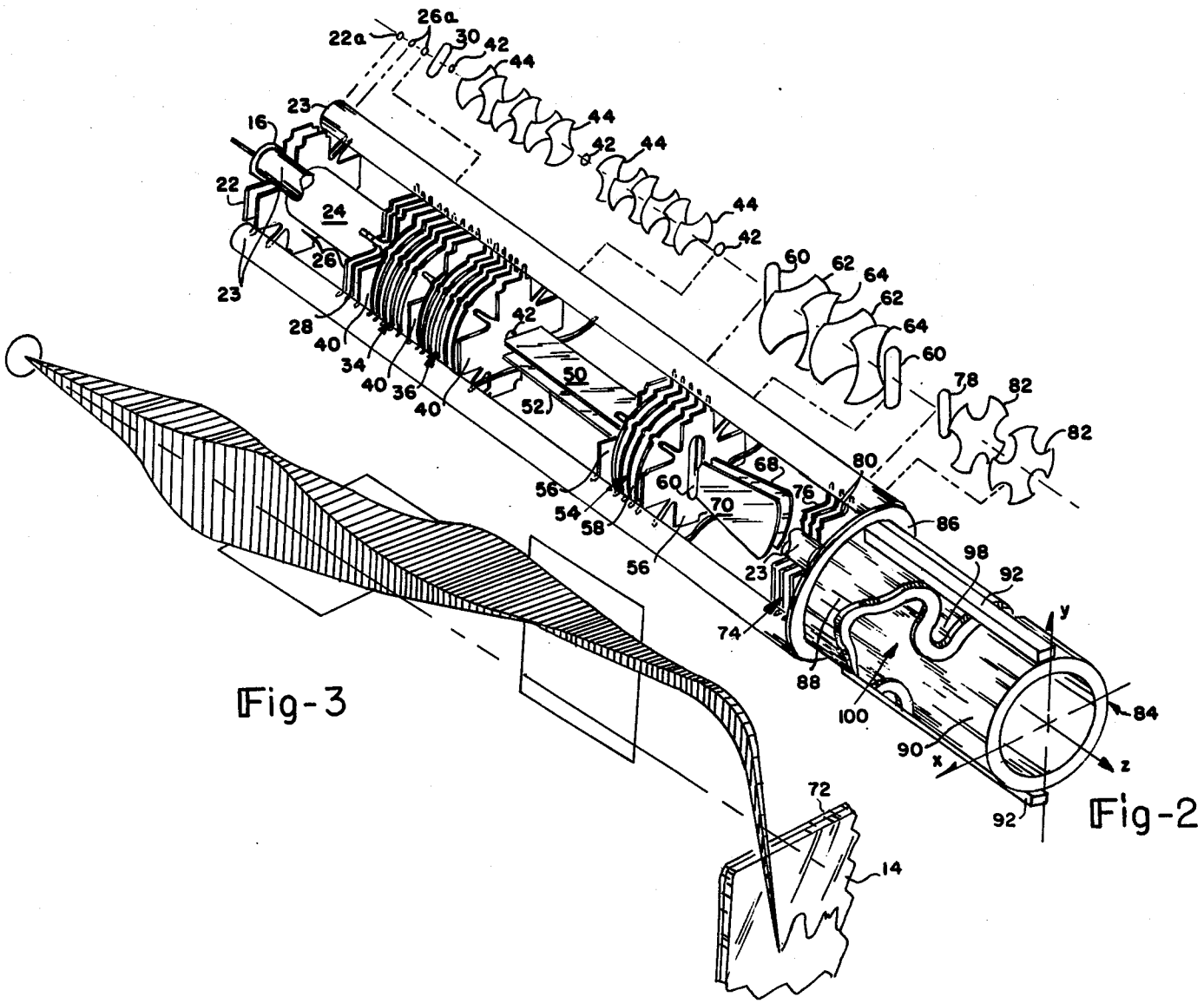
FIG. 2 is a perspective view of the electron optics system of the tube of FIG. 1 showing the aperture formations in the plates as exploded therefrom.
FIG. 3 is a perspective view of an electron beam envelope formed by the electron optics system of FIG. 2.

FIG. 3 illustrates an enlarged electron beam envelope which is formed by the electron lens system of FIG. 2 in accordance with the indicated voltages applied to the various lens means 22, 24, 34, 36, 54, 74 and 84 and incoming signals that are to be displayed on screen 72 which are applied to the vertical deflection plates 50 and 52 and the sweep signals which are applied onto the horizontal deflection plates 68 and 70.

The tubular member 90 having opposing trilobular sections 100 may be of larger diameter than tubular member 88 and its opposing bilobular sections 98, but these tubular members 88 and 90 are still mounted in axial alignment. Also, tubular member 90 and its opposing trilobular sections 100 may have a smaller diameter than tubular member 88 and its opposing bilobular sections 98 with the smaller tubular member 90 being disposed in a coaxial manner within tubular member 88 and bilobular sections 98 and trilobular sections 100 extend toward screen 72 with bilocular sections 98 being disposed at right angles with respect to trilobular sections 100. Also, the tubular member 90 may be a cylinder with a larger diameter than the tubular member 88 and it may be dispersed co-axially to encompass all the lobes of the member 88.

As can be discerned from the foregoing, a unique cathode ray tube is disclosed having electron lens means in the form of dual quadrupole lens means positioned before the vertical deflection means, another quadrupole means is disposed between the vertical deflection means and the horizontal deflection means and a fruther quadrupole lens means of unique construction is part of the post deflection acceleration means and provides much improved linearity and geometry of the electron beam scan which eliminates beam distortions and aberrations such as pin cushion, barrel and other effects.

It will be obvious to those having skill in the art to which the present invention pertains that many changes can be made in the above-described details of the preferred embodiment of the present invention without departing from the scope of the invention. For example, the electron lens structure of the present invention can be used in other cathode ray tubes including charge image storage tubes having transmission type mesh storage targets or simplified storage targets of a phosphor layer and target electrode disposed on a glass or insulating support plate. Therefore, the scope of the present invention is to be determined by the following claims.

The invention is claimed in accordance with:

1. A cathode ray tube, comprising:

an envelope having a fluorescent screen at one end and an electron gun at another end for producing an electron beam directed toward said screen;

deflection means disposed along a tube axis of said envelope and including elements for deflecting said electron beam in mutually perpendicular directions;

first quadrupole lens means disposed along said tube axis and positioned before said deflection means for focussing said electron beam in mutually perpendicular directions and second quadrupole lens means disposed along said tube axis and positioned between said elements of said deflection means for amplifying the electron beam deflection(s) while maintaining the electron beam velocity constant; and scan expansion post deflection acceleration means disposed along said tube axis between said deflection means and said screen for expanding the scan and simultaneously accelerating said electron beam for impinging onto said fluorescent screen to display an image thereon, said scan expansion post deflection acceleration means including tubular members, at least one of said tubular members having lobular sections positioned relative to each other to provide an accelerating quadrupole lens means.

2. A cathode ray tube according to claim 1 wherein said tubular members are in alignment and said lobular sections define interdigitated bilobular and trilobular sections.

3. A cathode ray tube according to claim 3 wherein said tubular member having said trilobular sections is positioned closest to said fluorescent screen and is connected to a high voltage conductive means disposed on the inside surface of said envelope.

4. A cathode ray tube according to claim 1 wherein said quadrupole lens means comprises spaced plate means having apertures of specific configurations therethrough to provide quadrupolar fields for controlling said electron beam as it passes therethrough.

* * * * *